United States Patent [19]

Sarka

[11] 4,137,829

[45] Feb. 6, 1979

[54] CUTTING APPARATUS

[76] Inventor: Albert J. Sarka, 18828 Canyon Dr., Fairview Park, Ohio 44126

[21] Appl. No.: 760,663

[22] Filed: Jan. 19, 1977

[51] Int. Cl.[2] ..... B31B 1/16

[52] U.S. Cl. ..... 93/36 A; 93/58.2 R; 93/58.4

[58] Field of Search ..... 93/36 A, 58.2 R, 58.2 F, 93/59 ES, 58 R, 58.1, 58.4; 83/343, 344

[56] References Cited

U.S. PATENT DOCUMENTS

| | | | |
|---|---|---|---|
| 2,682,208 | 6/1954 | Monroe et al. | 93/58.2 R X |
| 3,142,233 | 7/1964 | Downie | 93/58.2 R |
| 3,186,274 | 6/1965 | Winkler et al. | 93/36 A |
| 3,410,183 | 11/1968 | Sarka | 93/36 A |
| 3,882,765 | 5/1975 | Tokuno | 93/58.2 R |

*Primary Examiner*—James F. Coan

[57] ABSTRACT

A pair of cylinder arbors have a plurality of arcuate cylinder segments extending circumferentially around a portion of the arbor. The segments are adjustable relative to the arbors in a circumferential direction. Each of the segments has a respective cutting and/or scoring die plate secured thereto. The die plates are relatively thin plates having lands formed thereon which cooperate with lands formed on the die plates on the other arbor to cut material moving through a nip defined by the segments. The material is cut by the lands into carton blanks for example, and broke. The broke is suitably separated from the carton blanks. The segments on one of the cylinder arbors carries a movable broke removing mechanism which includes pins which engage the broke. The pins extend through openings in the segments and die plates thereon and are actuated by an axially movable cam bar which is situated from a suitable cam. Further, a mechanism adjusts the cylinder arbors toward and away from each other for various carton blank print lengths. The segments which are positioned on the arbors are changed also for different print lengths. Specifically, different radial thickness segments are mounted on the arbors. Further, the apparatus is provided with an on-the-run adjustment mechanism for adjusting the radial dimension between the dies at the cutting nip.

10 Claims, 11 Drawing Figures

FIG. 1
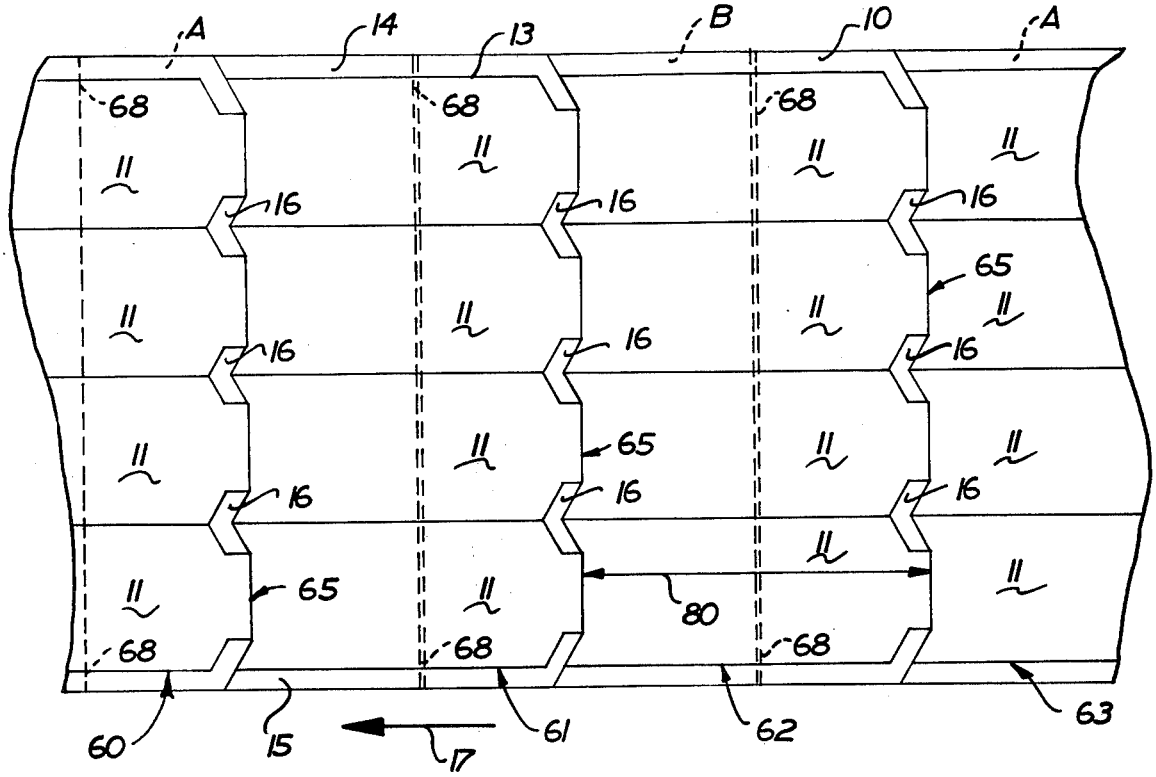
FIG. 2
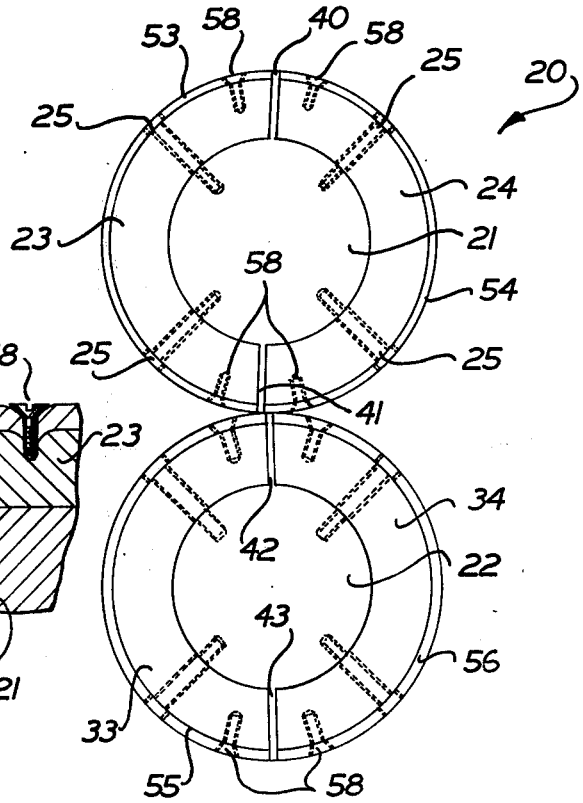
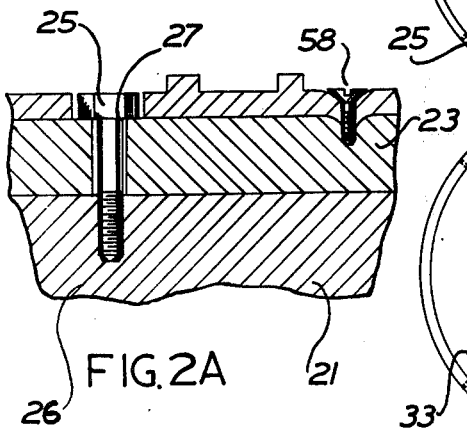
FIG. 2A

CUTTING APPARATUS

BACKGROUND AND SUMMARY OF THE PRESENT INVENTION

The present invention is directed to a new and improved cutting unit which is adapted to operate in line with a printing unit to cut and/or crease material printed in the printing unit.

Typically, cutting units have been used in line with printing units. The printing units normally print a plurality of carton blank printed images in a printed array. The cutting unit normally includes cutting cylinders which define a nip therebetween which receives the printed material from the printing unit. The cutting cylinders carry suitable cutting dies for purposes for cutting the printed image of the carton blanks from the material. Further, some provision is made for the removal of broke from the carton blanks.

Cutting dies which have been utilized with cutting equipment of the above-noted type have included die plates such as shown in U.S. Pat. No. 3,485,146 and U.S. Pat. No. 3,142,233. These patents disclose cutting and scoring dies which are formed of thin metal sheet material having lands formed thereon. The die plates may be formed in a variety of different ways and such will not be described herein. The die plates are relatively flexible and can be bent in an arcuate configuration and secured on cutting cylinders, which define a nip therebetween. The cooperating die plates include cutting lands which are formed substantially in a mirror image on the cooperating die plates. the cutting lands are spaced radially apart at the cutting nip so that the cutting lands never touch during the cutting operation. Typically, the cutting lands are formed so that there is a small amount of overlap of the cutting lands on the respective arbors at the cutting nip. The type of cut which is performed by such cutting lands has been termed a rupture cut.

The provision of a suitable apparatus for effectively utilizing the rupture cut principle has had a substantial amount of attention. Many patents disclose machinery relating to the use of such dies, for example, U.S. Pat. Nos. 3,375,762; 3,379,351; 3,578,761 and 3,435,737. Also, many patents relate to methods of making such dies, for example, U.S. Pat. Nos. 3,580,676 and 3,895,947.

The problems of adjustment in known apparatus has been acute since the die plates must be properly adjusted relative to each other and the printed image for purposes of effecting the cut. Also, the fact that the die plates are formed in the flat and then bent to extend through a substantial arc around a cylinder has created problems and inaccuracies. Further, the die plates have been made through the use of a step and repeat machine which also introduces inaccuracies when the die plates are relatively large.

In accordance with the present invention, an improved rotary cutting and creasing apparatus is provided which is capable of ready adjustment depending upon print length size of the image and which utilizes the rupture cut principle. In accordance with the present invention, a plurality of cylinder segments are secured to arbors which extend parallel to each other. The segments extend longitudinally of the arbor and extend around a portion of the circumference of the arbor. Each segment is provided with an individual die plate of the rupture cut type. The die plate is preferably formed in such a manner that the transverse cut line between adjacent carton blank images is located generally centrally of the die plate. Register means is provided adjacent the center of the die plate or segment to assist in registering the die to the printed image. Also, preferably, the segments have a circumferential length such that small gaps are formed in the nature of ten thousandths to thirty thousandths of an inch between the ends of the segments. These gaps enable the segments to be slightly adjusted circumferentially relative to the arbor for purposes of effecting proper cutting of the material and also for adjusting one part of the die plate relative to another part of the die plate.

Also, since the segments are removable, different thickness segments can be positioned on the arbors. This adjustment can readily occur for purposes of print length variation. The use of segments with individual die plates also minimizes the problem of inaccuracies which are created in the prior art due to the fact that a single die plate is secured substantially around a cylinder. Further, simplification in making the die plates is achieved since the step and repeat operation or the equivalent is simplified. Also, damage to one die plate requires replacement of only that small die plate as opposed to the prior art where the entire large die plate had to be replaced.

Further in accordance with the present invention, the gaps which are formed between the segments on one cylinder are preferably offset from the gaps which are formed between the segments on the other cylinder when the gaps arrive at the cutting nip. It has been discovered that the rupture cut principle is such that even though such gaps do occur, the cut line will propagate across the gap and an effective cut will occur even though the gaps are present. The offsetting of the gaps at the nip minimizes any nicking or the like which might occur and assists in the propagation of the cut line across the gaps.

Further in accordance with the present invention, the segments are provided with suitable pins for assisting in the removal of broke from the carton blanks after the carton blanks are cut from the material. Specifically, the segments on one of the arbors is provided with a plurality of pins and a cam bar which actuates the pins. The cam bar is operated by a cam which moves the bar axially of the cylinder and which bar on movement actuates the pins. The pins engage the broke and assist in the removal of the broke. Since the pins, bar and segment are unitary, quick easy mounting on the machine is enabled.

Further in accordance with the present invention, the arbors are adjustable toward and away from each other for purposes of adjusting the radial gap between the arbors. This adjustment is a running adjustment and can be effected during rotation of the arbors even though the arbors are gear driven. This running adjustment is provided by a unique structural arrangement of the gear drive to the arbors which enables the running adjustment to occur while the arbors are being gear driven.

BRIEF DESCRIPTION OF THE FIGURES

Further objects and advantages of the present invention will be apparent to those skilled in the art to which it relates from the following description of a preferred embodiment thereof made with reference to the accompanying drawings in which:

FIG. 1 is a view of material showing an illustrative carton blank image array and broke which are to be cut from the material by the apparatus of the present invention;

FIGS. 2 and 2A are somewhat schematic views illustrating the arbors and the segments mounted thereon;

DESCRIPTION OF PREFERRED EMBODIMENT

Figure 3:
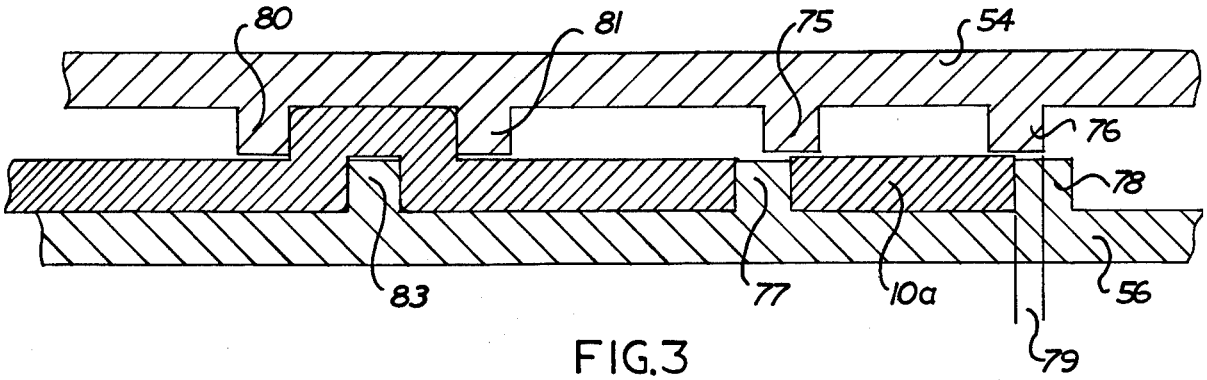
FIG. 3 is a view showing rupture cut die plates which may be utilized in the present invention.
Figure 4:
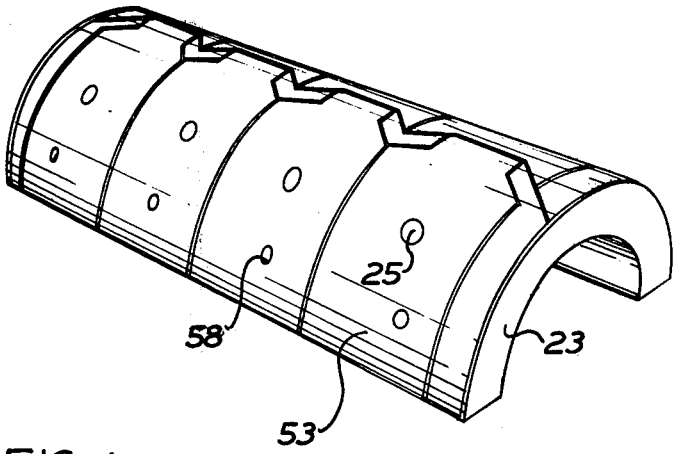
FIG. 4 is a schematic view of a cylinder segment with a die plate mounted thereon.

As noted hereinabove the present invention relates to an apparatus for cutting material, for example cutting carton blank images from printed material. The cutting apparatus of the present invention is adapted to be located in line with a printing unit which prints an array of carton blank images on the material. The printing unit prints the image of the carbon blanks on the material and the material is continuously advanced from the printing unit to the cutting apparatus of the present invention. The cutting apparatus is constructed to cut the image of the carbon blanks from the material with the remaining waste material being broke. The particular carton blank which is cut by the present invention may take a variety of different forms. Further, the apparatus may effect creasing of the carton blanks where the blank is to be folded by carton forming machinery.

As illustrated in FIG. 1, the material which is advanced from the printing unit has a series of continuous images of carton blanks formed thereon. As shown in FIG. 1, the material is a web generally designated 10. The web has individual carton blank images printed thereon each of which is designated 11. The individual carton blank images 11 are defined thereon by an outline designated 13. The outline of the carton blank image is to be cut by the cutting apparatus of the present invention to form individual carton blanks. As illustrated in FIG. 1, the carton blanks have areas of internal waste or broke 16 interposed therein and broke which includes the outer peripheral edges 14 and 15. While the carton blank does have crease lines where the blank is to be creased during carton formation, such crease lines are not illustrated in FIG. 1.

The segment of the material which is illustrated in FIG. 1 includes more than two carton blank lengths, and the carton blanks are spaced four abreast across the direction of movement of the material. The arrow 17 indicates the direction of movement of the material from the printing unit into the cutting unit.

The material 10 is advanced from the printing unit into a cutting unit 20 constructed in accordance with the present invention. The unit 20 is shown schematically in FIG. 2. Specifically, the cutting unit 20 includes a pair of vertically spaced cylinder arbors 21, 22. The cylinder arbors 21, 22 extend parallel to each other and are of the same length. The arbors 21, 22 are suitably driven about their own axes as will be described hereinbelow.

The cylinder arbor 21 has a pair of arcuate cylindrical segments 23, 24 mounted thereon. The cylinder segments 23, 24 are of equal axial length and have equal circumferential extents. The segments 23, 24 are suitably secured to the arbor 21 by a plurality of bolts 25. The bolts 25 extend into threaded openings 26 in the arbor 21 as shown in FIG. 2A. The bolts 25 extend through holes 27 in the segments 23, 24. The holes 27 are large enough to provide a small clearance between the bolts 25 and the segments 23, 24. Thus, by loosening the bolts 25 a segment can be shifted slightly circumferentially of the arbor. As should be clear in FIG. 2, the segments 23, 24 are both secured to the arbor 21 in a similar manner for purposes of adjustment of the segments on the arbor 21.

The arbor 22 has a pair of segments 33, 34 secured thereto. The segments 33, 34 are secured to the arbor 22 in a manner similar to how the segments 23, 24 are secured to the arbor 21. Accordingly, the segments 33, 34 are also circumferentially adjustable on the arbor 22. The number of segments on an arbor can vary. As illustrated in the drawings, the arbor 21 and the arbor 22 each have two segments 23, 24 and 33, 34 mounted thereon respectively. However, three or more segments could be mounted thereon.

The segments 23, 24 and 33, 34 which extend around the respective arbors 21 and 22, preferably have a circumferential extent which is less than 360°. Thus the segments 23, 24 have gaps which are located intermediate the ends of the segments. This is true also of the segments 33, 34. As illustrated in FIG. 1, the segments 23, 24 have a circumferential gap 40 located therebetween and a second circumferential gap 41 located therebetween diametrically opposite gap 40. The segments 33, 34 have diametrically opposite gaps 42, 43 therebetween. The gaps 40, 41 and 42, 43 are somewhere between ten-thousandths of an inch and thirty-thousandths of an inch in circumferential dimension, and are exaggerated in the drawings. These gaps 40, 41 and 42, 43 enable circumferential adjustment of the segments on the arbors 21, 22 to be effected, as should be apparent.

Each of the segments 23, 24 and 33, 34 have individual cutting and creasing die plates secured thereto. The die plates secured to segments 23, 24 are designated 53, 54, respectively. The die plates secured to the segments 33, 34 are designated 55, 56, respectively. These die plates are secured to their respective cylinder segments in any suitable manner, such as by adhesive or by suitable fasteners 58, only a few of which are shown. The fasteners 58 are recessed into the die plate so that they do not interfere with the operation of the die plates. Also, a chamfer is provided on the tapped hole in the segments which receive fasteners 58 so that the plate becomes bent into the chamfer when secured to the setment, as shown in FIG. 2A. Also, the die plates have openings therethrough which align with the bolts 25. Thus the bolts 25 can be loosened and the segments adjusted on their arbors after the die plates are secured to the segment.

The die plates 53, 54 and the die plates 55, 56 are of similar construction. The die plates 54, 56 cooperate to perform a cutting and creasing operation on one portion of the material 10 whereas the die plates 53, 55 cooperate to perform a cutting and creasing operation on another portion of the material 10. The die plates 55, 56 engage the underside of the material 10 whereas the die plates 54 and 53 engage the upper side of the material 10 as the material 10 is advanced through the nip defined by the die plates, in the illustrated embodiment.

As best illustrated in FIG. 1, the areas designated A as outlined by dotted lines, in FIG. 1 are cut by the die plates 54, 56 and the cutting is effected along the solid outlines 13 which are illustrated in FIG. 1. The die plates 53, 55 perform a cutting operation on the area outlined by dotted lines and designated B on the material 10 of FIG. 1. The areas A and B are identical and alternate along the length of material 10.

It should further be apparent as illustrated in the drawings that the carton blank images are divided into rows which extend horizontally across the material 10. Four rows are shown in the drawings, each row being designated 60, 61, 62 and 63. Each horizontal row of carton blank images is separated by a horizontal or laterally extending cut line 65. The horizontally extending cut line 65 extends transverse to the direction of movement of the material 10 and also extends axially of the cylinder arbors 21, 22.

The cut lines 65 which separate the rows of carton blank images are located generally centrally of each of the die segments 53, 54, 55, 56 respectively. Accordingly, the portion of the carton image or outline 13 which is cut in the area of the gaps 40, 41, 42 and 43 is the portion of the outline 13 generally designated 68 as illustrated in FIG. 1. It has been discovered that even though the gaps 40, 41 42, 43 are present, the cut in the area 68 is continuous, and in effect cutting occurs across the gaps for purposes of providing a continuous cut on the material along the cut line in the area 68.

It should further be apparent as illustrated in FIG. 2 that the die plates and segments are mounted on the arbors 21 and 22 so that the gaps, namely 41, 42 and 40, 43 respectively are offset at the nip where the cutting action occurs when those gaps arrive at the nip. Specifically, the gaps are offset circumferentially so that the gap 41 is not directly opposite the gap 42 nor is the gap 40 immediately opposite gap 43 when these gaps are located adjacent the cutting nip. This offsetting has been found to specifically minimize nicking which is pieces of material interconnecting portions of the carton blanks with the broke. As a result, a continuous cut line tends to be created as opposed to a non-continuous cut with nicks which connect the carton blanks to the broke which encircles the carton blank.

The die plates 53, 54, 55, 56 which are mounted on the respective cylinder segments are of the type shown in U.S. Pat. Nos. 3,485,146 and 3,142,233. Specifically, the die plates are thin metal plates which are readily bent around the circumference of the cylinder segments. The bending of the die plates and the fact that the plates are only small segments (less than one-half of the total circumferential extent of the arbors) enables the individual plates to be accurately manufactured and also reduces inaccuracies which are created due to bending of the die plates substantially around a cylinder.

Specifically, the die plates 54, 56, for example, include lands 75, 76 formed on die plate 54 and cooperating lands 77, 78 formed on the other die plate 56. The lands 75, 76 cooperate with the lands 77, 78, respectively, to cut material therebetween at the nip formed by the die plates. The lands 75, 76, respectively, overlap the lands 77, 78 (as shown exaggerated in FIG. 3) at the cutting nip. The overlap is designated 79 in the drawings.

These lands cooperate and effect a so-called rupture cutting of the material. The rupture cut is effected as a result of the fact that the lands, while they preferably overlap do not radially touch each other at the nip during the cutting action on the material. Alsno, note the lands 75, 76 are located more closely than lands 77, 78. This may be termed a "non-predominant" cutting. Such results in pieces of material sticking on the dies, such as piece **10*a* shown in FIG. 3. Such is broke and preferably broke areas 16**.

For purposes of creasing the material, the die plates include lands 80, 81 on the die plate 54 which may be termed female scoring lands and a male scoring land 83 on die plate 56. The land 83 forces material between the female lands 80, 81 to form a crease line, as shown in FIG. 3.

As noted above, these die plates in the art have been formed so that they extend substantially completely around the circumference of a cylinder on which they are mounted. The bending of the plates around substantially the total circumference of a cylinder has resulted in inaccuracies in the cutting operation. This is due to the fact, among others, that tension varies on one portion of the die plate as opposed to another portion, and accordingly a carton image size on one portion of the die plate may vary from the carton image size on another portion of the die plate.

By separating the die plate into a plurality of segments which extend circumferentially around the cylinders, the above inaccuracies and others which are inherent in the use of die plates which extend around substantially the total circumference of the cylinder are avoided. Further, the ability of adjust the die plates individually circumferentially of the cylinders due to adjustment of the segments on their arbors also tends to cancel out the inaccuracies which are inherent in the manufacture of the die plate by known processes.

Further, due to the fact that the segments are removable from the arbors 21, 22, different thickness segments can be applied to the arbors 21, 22. The different thickness segments on the arbors 21, 22 is necessary when the print length of the carton blank changes. The print length of the carton blank is shown as 80 in FIG. 1 and consists of the length of the carton blank in the direction of feed of the material. For example, if the carton blank images were increased in length, different segments may be used which have a different radial dimension. By changing the segments, it is not necessary to remove the arbors 21, 22. This is another advantage of the use of segments such as shown in Henc U.S. Pat. No. 3,119,312.

Of course, the change in thickness of the segment also requires that the arbors 21, 22 be adjusted vertically relative to each other. The vertical adjustment is also necessary for purposes of properly spacing the cutting lands on the die plates appropriately relative to each other for purposes of effecting a proper rupture cut. Further, the die plates require axial adjustment of one of the arbors relative to the other for purposes of getting the cutting and scoring dies in the proper location relative to each other. Accordingly, the present apparatus is provided with suitable mechanism for adjusting the arbors 21, 22 relative to each other both vertically and axially in order to align the cutting and scoring die lands properly. These various adjustments are best shown in FIGS. 6 through 10.

In order to facilitate register of the die plates to the image printed on the carton blanks, the die plates are provided with register holes adjacent the cutting lands for forming the cut 65. Such register holes are indicated schematically as X in FIG. 1. These register holes are adapted to be aligned with register marks, or the like, on the segments so that the die plates are positioned on the segments in a proper orientation.

Figure 7:
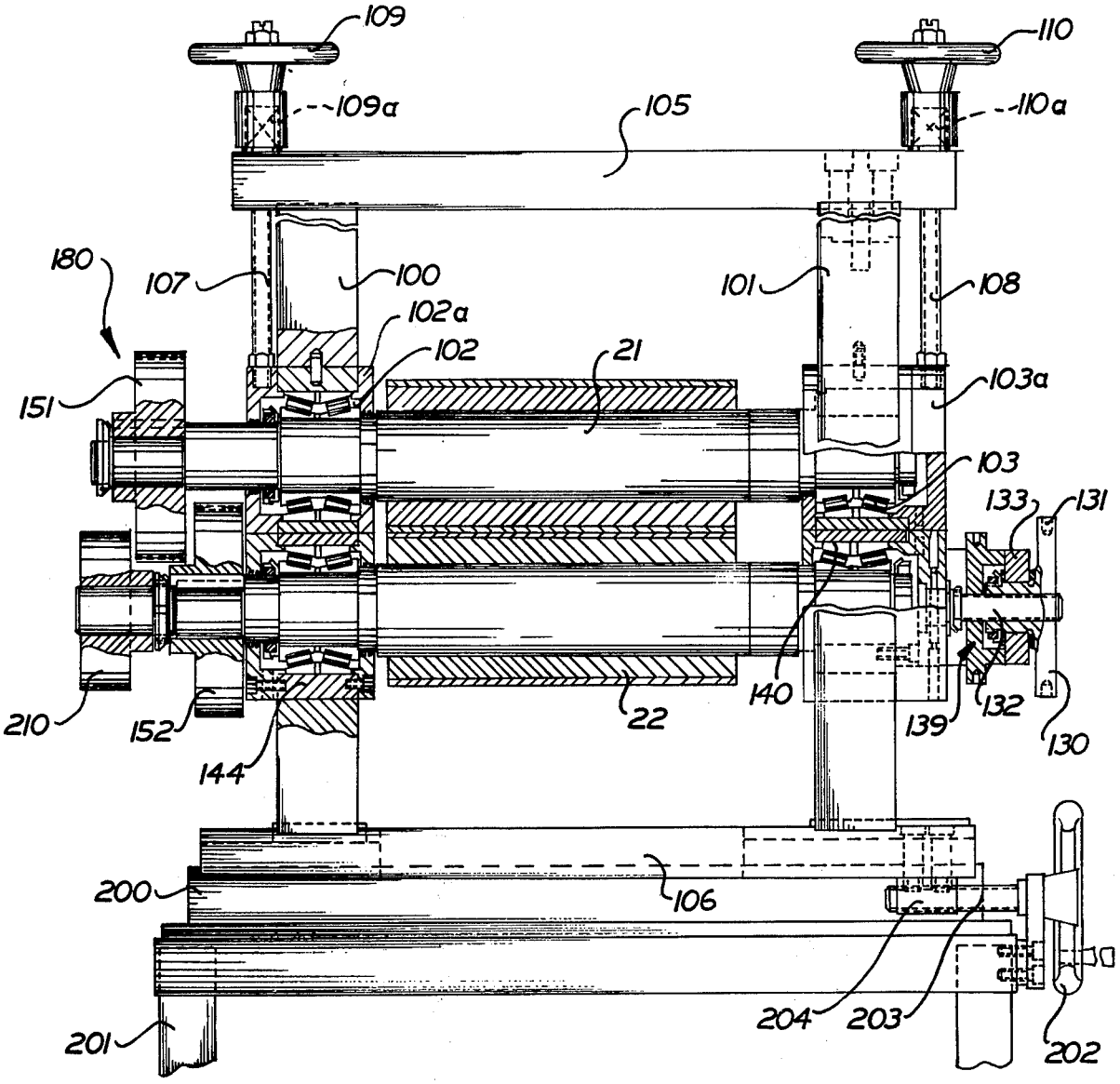
FIG. 7 is a sectional view of the apparatus embodying the present invention and with parts removed.

Referring now to FIG. 7, the arbors 21, 22 are shown associated with a pair of side frames 100, 101. One end of the arbor 21 is supported by a bearing 102. The other end of the arbor 21 is supported by a bearing 103. The side frame members 100, 101 are interconnected by a top frame member 105 and a bottom frame member 106, all of which are suitably secured together. The bearings 102, 103 for the arbor 21 are supported in bearing blocks **102*a*, 103*a*, which are connected to vertically extending rods 107, 108, respectively. The bearing blocks 102*a*, 103*a* are slidably supported in the side frames for vertical adjustment relative thereto. The connecting rods 107, 108 extend through the upper frame member 105 and suitable handwheels 109, 110, respectively, are threaded on threaded portions of the connecting rods 107, 108. Springs 109*a*, 110*a* are interposed between the upper frame member 105 and the handwheels 109, 110, respectively. These springs urge the rods 107, 108 and bearing blocks 102*a*, 103*a* vertically. By rotation of the handwheels 109, 110, the bearing blocks 102*a*, 103*a* are moved vertically relative to the side frames and accordingly the arbor 21 is moved vertically relative to the side frames. The springs 109*a*, 110*a* urge the bearing blocks 102*a*, 103*a* into engagement with double wedge constructions 120 located at opposite sides of the unit and associated with the side frames 100, 101**.

The arbor 21 is adjusted accurately vertically by the double wedge constructions 120, each of which is of identical construction.

The double wedge construction 120 (FIG. 6) includes a first wedge member 121 which engages the upper side of the bearing block **103*a*and a second wedge 122 which has in inclined surface which mates with the inclined surface of wedge 121. The wedge 122 may be moved laterally relative to the wedge 121 by a pair of handwheels 125, 126. By rotation of the handwheels 125, 126 in the appropriate direction, the wedge 122 is moved laterally of the machine. A stop member 129 engages the upper side of the wedge 122 and prevents raising thereof. The wedge 122 is provided with a slot 127 receiving stop 129 to enable the lateral movement thereof to occur. When the wedge 122 moves in one direction, it applies a bearing force on the wedge 121 which, in turn, effects vertical downward movement of the bearing block 103*a* for the bearing 103. If the wedge moves in the reverse direction, the springs 109*a*, 110*a* raise the arbor 21. For purposes of providing a wide range of adjustment, a vertical spacer block can be removably interposed between each bearing block 102*a*, 103*a* and the wedge constructions 120, respectively. This would enable the wedge constructions to operate when in the absence of such a spacer, the arbors could not be properly positioned vertically relative to the wedge construction and specifically handwheels 125, 126**.

For purposes of axial adjustment, the arbor 22 is provided with a suitable handwheel 130. The handwheel 130 has a plurality of wrench openings 131 therein which receive a wrench which, when turned, effects rotation of the threaded shaft 132. The shaft 132 is threaded into a fixed frame member 133 and upon rotation of the shaft 132, causes the bearing blocks 140, 144 of the arbor 22 to move axially in the frames. This results in the arbor 22 likewise moving axially. A suitable nut arrangement 139 is provided to lock the arbor in its adjusted axial position.

Accordingly, from the above it should be apparent that the arbors 21, 22 are adjustable axially relative to each other, and vertically relative to each other in order to align the cutting and scoring dies so that the respective lands thereon are properly located relative to each for effective cutting and creasing of the material which progresses through the cutting nip.

The adjustments of the arbors is such that the adjustments are running adjustments and can be made without disengaging the drive to the arbors 21, 22. Specifically, the arbors 21, 22 are driven by a suitable gear mechanism, generally designated 150. The gear mechanism 150 includes a first gear 151 which is drivingly connected to the upper arbor 21 and mounted on the axis of the arbor 21, and a second gear 152 which is drivingly connected to the lower arbor 22 and mounted coaxial with the arbor 22. The drive from a suitable motor is into the gear 152 which causes rotation of the lower arbor 22. The gear 152 meshes with a gear 153. The gear 153 is supported on a shaft **153*a* spaced laterally of the axis of arbor 22. The gear 153 meshes with a gear 154 mounted on shaft 155. The shaft 155 is located vertically above shaft 153*a* and extends parallel thereto. The gear 154 is a double gear having two gear portions bolted together by a bolt 149. The gear 154 meshes with the gear 151 and gear 153. As best shown in FIG. 7, the gears 152, 151** are offset axially relative to each other.

Figure 8:
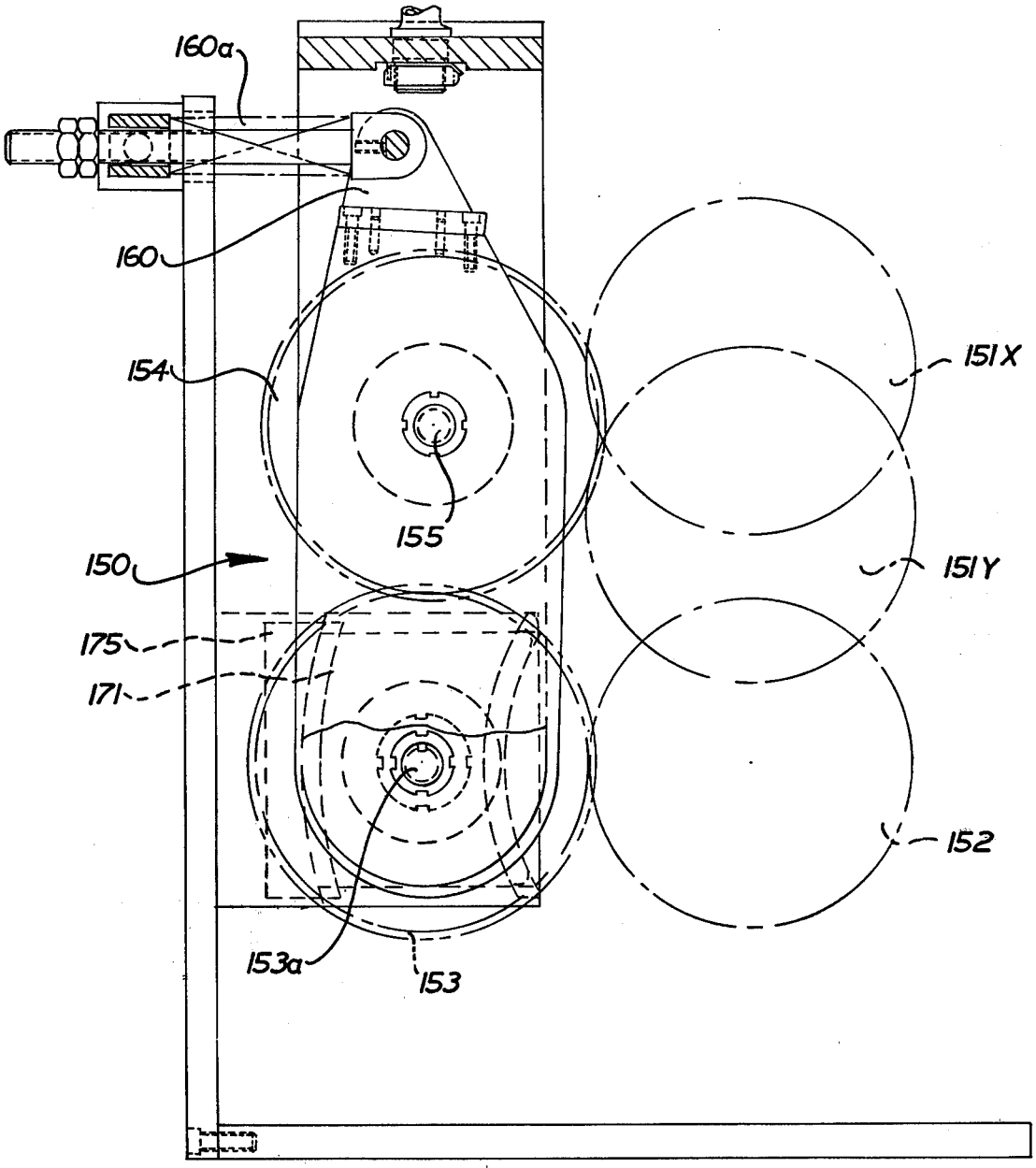
FIG. 8 is a side view of the apparatus shown in FIG. 7 looking from the left and with parts removed and parts illustrated schematically.
Figure 9:
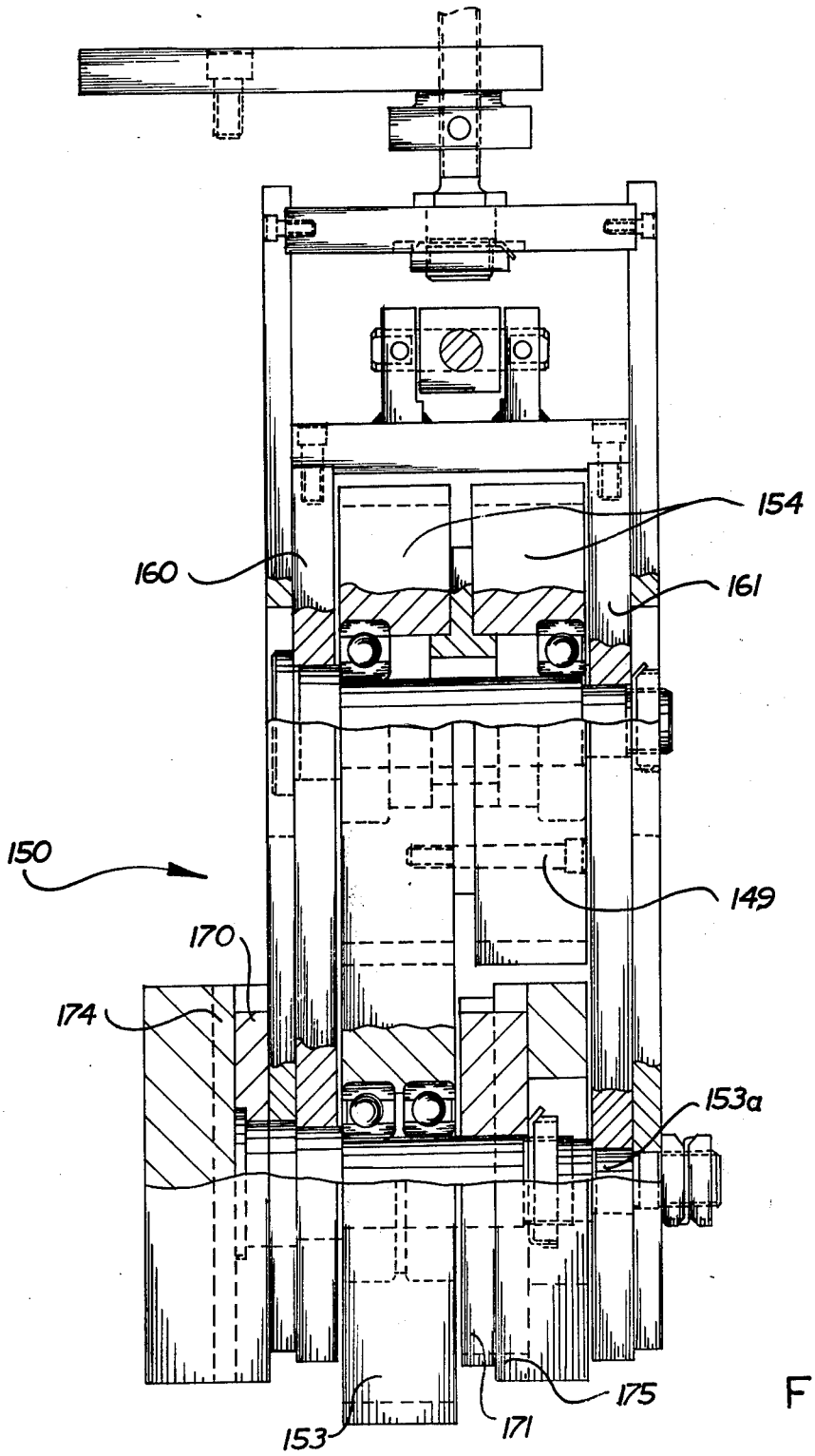
FIG. 9 is a view looking at the structure shown in FIG. 8 from the right.

Upon vertical adjustment of the arbor 21, the gear 151 moves vertically with the arbor 21. FIG. 8 shows two positions **151*x* and 151*y* for the gear 151. The gear mechanism is arranged so that the gear 151 can move vertically with the arbor 21 without destroying the drive to the arbors, and thus the vertical adjustment is a running adjustment. To this end, the gear 154 and, specifically, the shaft 155 thereof is mounted in a pair of side plates 160, 161. The side plates 160, 161 are mounted for pivoting movement about the axis of the shaft 153*a*. A suitable spring 160*a* pivots the side plates 160, 161 about the axis of the shaft 153*a* toward the gear 151. Thus, as the gear 151 moves vertically, the gear 154 can move toward or away from the axis of rotation of the gear 151 due to the spring 160*a* yielding or urging the gear 154 into meshing engagement with the gear 151. This is effected without destroying the meshing relationship between the gear 153 and the gear 152, or the meshing relationship between the gears 154 and 153**.

Figure 10:
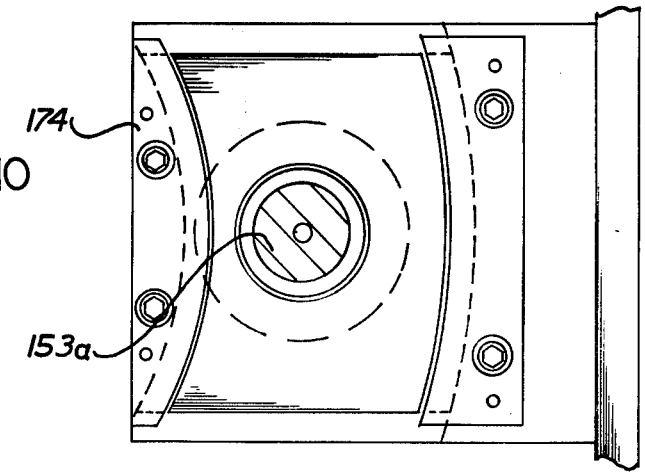
FIG. 10 is a fragmentary view of a part of the structure shown in FIG. 9.

Further, the shaft **153*a* of the gear 153 is mounted in a pair of guide blocks 170, 171. The guide blocks are identical, and one is best shown in FIG. 10. The guide blocks are provided with guide surfaces which are formed on an arc concentric to the center of the gear 152. The guide blocks 170, 171 move in fixed arcuate guides 174, 175, respectively, and are guided thereby for movement about the axis of gear 152. Accordingly, the shaft 153*a* and gear 153 thus are supported for movement about the axis of the gear 152**.

Accordingly, on vertical movement of the gear 151, the gear 151 tends to rotate the gear 154 and also tends to cause movement of the gear 154 toward or away from the axis of the gear 151. Since the gear 154 is urged toward the axis of the gear 151, the plates 160, 161 also tend to move toward and away from the axis of the gear 151. When this occurs, the gear 153 tends to bodily move or rotate about the axis of the gear 152. All of this movement is enabled by the fact that the gear 153 is free for movement about the axis of the gear 152. Accordingly, vertical movement of the gear 151 can occur, and likewise vertical movement of the arbor 21 during driving of the arbor 21 through the gear arrangement can occur without disturbing the meshing engagement of the gears.

Axial adjustment of the gear 152 can occur relative to the gear 153 and also the gear 151 relative to the gear 154, due to the fact that the gear teeth thereon are spur teeth and limited sliding action of the gear teeth can occur for purposes of axial adjustment of the arbor 21 relative to the arbor 22.

From the above, it should be apparent that applicant has provided a significantly improved cutting and creasing apparatus which involves the use of segments secured to cylindrical arbors of the mechanism and that various thickness segments can be secured to the arbors depending upon print length and suitable running adjustments can be effected by the mechanism.

The mechanism further includes a suitable arrangement for the removal of broke 16 from the carton blanks and which mechanism is formed integrally with the segments which are secured to the cylindrical arbors. The mechanism of removing broke, as noted above, is formed integrally with the segments and, specifically, is formed integrally with the segments which are secured to the arbor 21.

Figure 5:
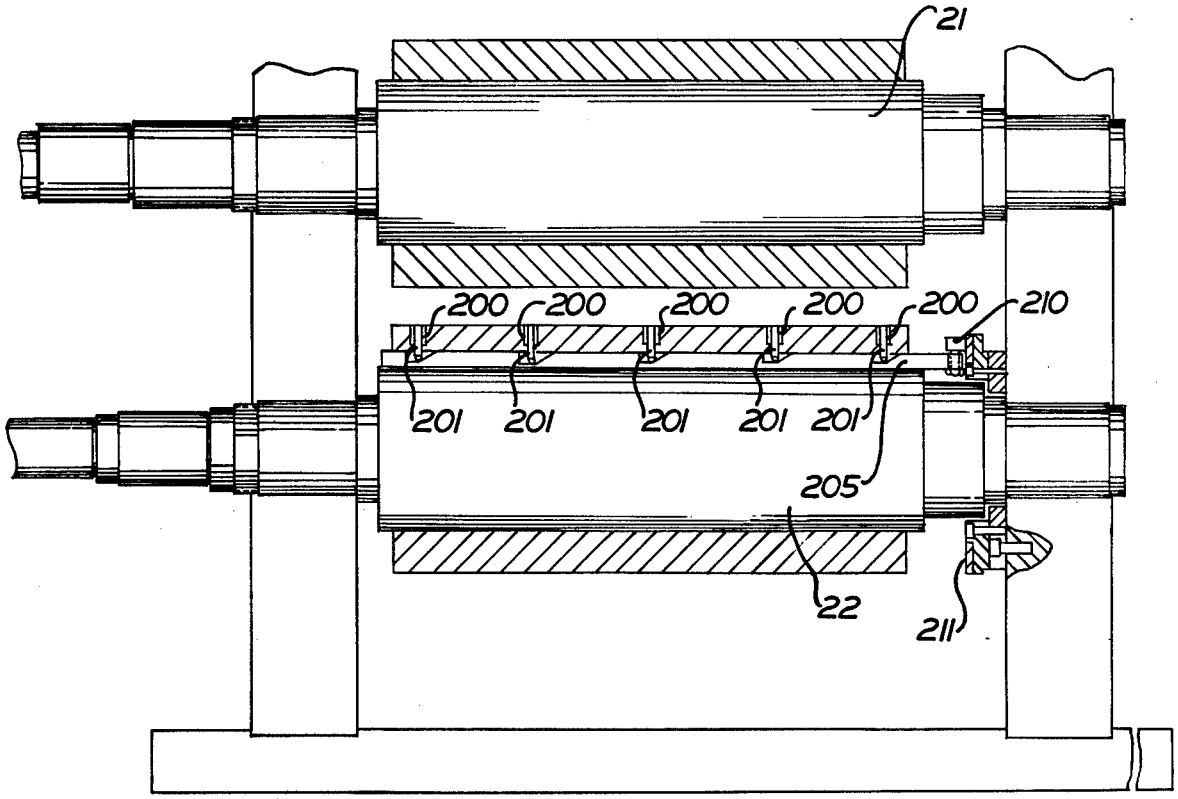
FIG. 5 is a sectional view of an apparatus embodying the present invention and illustrating the broke removal mechanism which is utilized in the apparatus.
Figure 6:
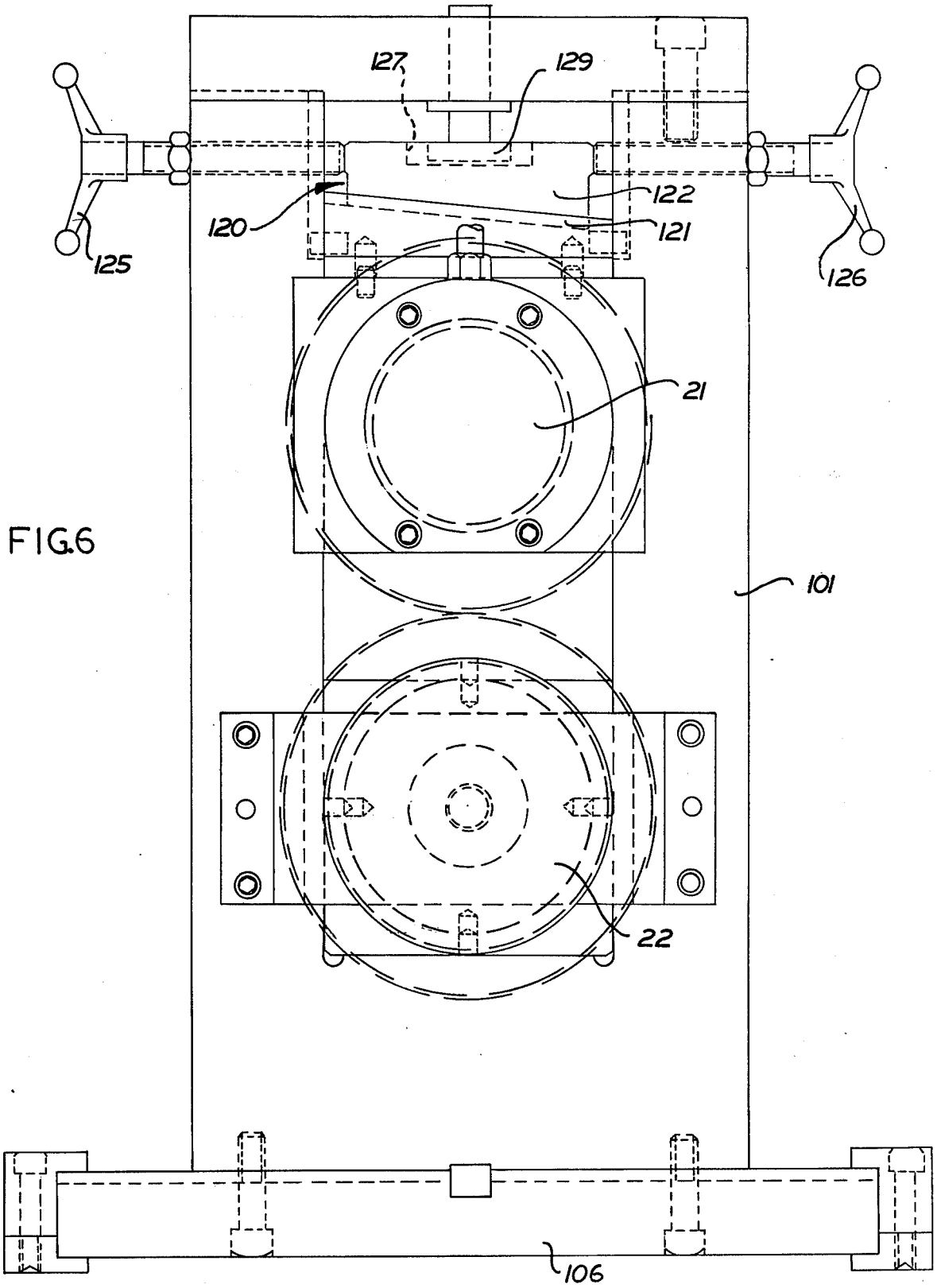
FIG. 6 is a side elevational view of the apparatus embodying the present invention with parts removed.

As shown in FIG. 5, the segments secured to the arbor 21 are formed with a plurality of openings 200 extending radially therethrough. The openings 200 have a plurality of pins 201 which extend therein and are suitably located for purposes of engaging the broke, as will be described hereinbelow. The pins on their radially inner ends engage with slots in an axially extending cam bar 205 which is located in a slot in the segment. The cam bar 205, at one end, has a follower 210 located thereon. The follower 210 engages with a cam 211 which is suitably bolted to the side frame of the machine. As the segments rotate with the arbor 21, the follower will effect axial movement of the cam bar 205. Axial movement of the cam bar 205 causes radial movement of the pins 201, as should be apparent. The pins 201 could have sharp points which would engage with and project into the pieces of broke 16 which are cut and formed by the cutting and scoring dies. As the segments rotate, the pieces of broke would then be stripped from the pins 201.

Alternatively, where the cutting and scoring dies are formed in a manner which is referred to as non-predominant cutting, as illustrated in FIG. 3, the broke becomes located in the die between the portions 77, 78. Accordingly, since the broke during the cutting action is located between the lands 77, 78, the pins need not impale the broke, but rather may have blunt faces thereon and merely move out and force the broke out of the cutting and scoring dies.

Further, as best shown in FIG. 7, the entire machine, including the frames 100, 101 can be moved laterally relative to the web 10. To this end the machine is supported on a way 200 fixed in a support 201. Specifically, frame member 106 is slidably supported on the way 200. A handwheel 202 is rotatably supported by the support 201 fixed, from axial movement relative thereto. The handwheel is mounted on a threaded shaft 203 which is threadedly engaged with a projection 204 from the frame member 106. Rotation of the handwheel 202 causes lateral movement of the frame member 106 and the entire machine on the support way 200. The drive from the motor to the shaft carrying gear 152 is through a coupling which includes a gear member 210 which slides axially relative to a cooperating gear member (not shown).

From the above it should be apparent that applicant has provided a new and improved cutting and creasing mechanism which may be utilized in line with a printing unit and which provides substantial advantages to the cutting and creasing art.

Having described my invention, I claim:

1. A cutting unit adapted to operate in line with a printing unit to cut material printed in the printing unit, said cutting unit comprising a pair of cylinder arbors extending parallel to each other and transverse to the direction of material movement, a plurality of arcuate cylinder segments on each arbor, each segment extending axially of the arbor, means removably securing said arcuate cylinder segments on said arbors and enabling circumferential adjustment of the segments relative to the arbor, each respective segment having cutting lands thereon defining a cutting nip, said cutting lands on one arbor being offset from the cooperating cutting lands on the other arbor at the nip and being radially spaced from the cooperating lands on the other arbor at the nip and operable to rupture cut material moving through the nip, axially extending gaps being provided between segments on the arbors, each of said segments being adjustable circumferentially on the arbors relative to any other segments on the arbor, and the axially extending gaps on one arbor being circumferentially offset from the axially extending gaps on the other arbor at the cutting nip.

2. A cutting unit adapted to cut material advanced therethrough, said cutting unit comprising a pair of cylinder arbors extending parallel to each other and transverse to the direction of material movement, a plurality of arcuate cylinder segments on each arbor with axially extending gaps between the segments, each segment extending axially of the arbor, means removably securing said arcuate cylinder segments on said arbors and enabling circumferential adjustment of the segments relative to the arbor, said means securing said arcuate cylinder segments to said arbors with said axially extending gaps between segments on the arbors and said segments thus being relatively adjustable circumferentially on the arbors, each respective segment having a thin die plate thereon with said cutting lands formed on said die plate, said cutting lands extending circumferentially and axially of said segments and effecting a continuous cut throughout the circumference of the segments and in the direction of advance of the material, means for securing each die plate to its respective segment, and said cutting lands on one arbor being offset from the cooperating cutting lands on the other arbor at the nip and being radially spaced from the cooperating lands on the other arbor at the nip and operable to rupture cut material moving through the nip.

3. A cutting unit as defined in claim 2 wherein the material being cut is separated at a cut line extending transverse to the direction of material movement, said die plates having cutting lands for cutting the material at said transverse cut line, said cutting lands for cutting said material at said transverse cut line being located generally centrally of said segments, and register means adjacent said cutting lands for registering said die plate thereto.

4. A cutting unit as defined in claim 2 wherein said cutting unit cuts said material into an article and broke and further including means for effecting removal of said broke from said nip in a path different from the path of movement of the articles.

5. A cutting unit as defined in claim 3 wherein each of said die plates has the same layout of cutting lands.

6. A cutting unit to cut material advanced therethrough, said cutting unit comprising a pair of cylinder arbors extending parallel to each other and transverse to the direction of material movement, cutting lands on each respective cylinder arbor and defining a cutting nip, said cutting lands extending circumferentially and axially of said arbors, said cutting lands on one arbor being offset from the cooperating cutting lands on the other arbor at the nip and being radially spaced from the cooperating lands on the other arbor at the nip and operable to rupture cut material moving through the nip, means for adjusting one of said arbors toward and away from the other, a gear drive to said one of said arbors including a first gear mounted coaxially of said arbor and fixed thereto for adjusting movement therewith and a second gear mounted coaxially of said other arbor and fixed thereto, gearing interposed between said first and second gears to transmit drive therebetween, means supporting said gearing to compensate for movement of said first gear with said one arbor without destroying the drive between said first and second gears so that said one arbor may be moved relative to the other during driving of said arbors, said gearing comprising third and fourth gears, said third gear meshing with said first and fourth gears and said second gear meshing with said fourth gear, and said means supporting said gearing comprising a linkage supporting said third gear for pivotal movement about the axis of said fourth gear toward and away from said first gear, means supporting said linkage and said fourth gear for pivotal movement about the axis of said second gear, and a spring biasing said third gear toward said first gear about said axis of said fourth gear.

7. A cutting unit adapted to cut material advanced therethrough, said cutting unit comprising a pair of cylinder arbors extending parallel to each other and transverse to the direction of material movement, a plurality of arcuate cylinder segments on each arbor, each segment extending axially of the arbor, means removably securing said arcuate cylinder segments on said arbors and enabling circumferential adjustment of the segments relative to the arbor, each respective cylinder segment having cutting lands thereon, said cutting lands extending circumferentially and axially of said segments and effecting a continuous cut throughout the circumference of the segments and in the direction of advance of the material, and said cutting lands on one arbor being offset from the cooperating cutting lands on the other arbor at the nip and being radially spaced from the cooperating cutting lands on the other arbor at the nip and operable to rupture cut material moving through the nip.

8. A cutting unit as defined in claim 7 wherein said plurality of arcuate cylinder segments on each arbor have axially extending gaps therebetween and are adjustable relative to each other, each respective segment having a thin die plate thereon with said cutting lands formed on said die plate, means for securing each die plate to its respective segment, and each of said die plates has the same layout of cutting lands.

9. A cutting unit adapted to cut material advanced therethrough, said cutting unit comprising a pair of cylinder arbors extending parallel to each other and transverse to the direction of material movement, a plurality of arcuate cylinder segments on each arbor with axially extending gaps between the segments, each segment extending axially of the arbor, means removably securing said arcuate cylinder segments on said arbors and enabling circumferential adjustment of the segments relative to the arbor, said means securing said arcuate cylinder segments to said arbors with said axially extending gaps between segments on the arbors and said segments thus being relatively adjustable circumferentially on the arbors, each respective segment having a thin die plate thereon with said cutting lands formed on said die plate, said cutting lands extending circumferentially and axially of said segments, means for securing each die plate to its respective segment, said cutting lands on one arbor being offset from the cooperating cutting lands on the other arbor at the nip and being radially spaced from the cooperating lands on the other arbor at the nip, and operable to rupture cut material moving through the nip the material being cut being separated at a cut line extending transverse to the direction of material movement, said die plates having cutting lands for cutting the material at said transverse cut line, said cutting lands for cutting said material at said transverse cut line being located generally centrally of said segments, and register means adjacent said cutting lands for registering said die plate thereto, and said axially extending gaps on one arbor being circumferentially offset from the axially extending gaps on the other arbor at the cutting nip.

10. A cutting unit adapted to cut material advanced therethrough, said cutting unit comprising a pair of cylinder arbors extending parallel to each other and transverse to the direction of material movement, a plurality of arcuate cylinder segments on each arbor with axially extending gaps between the segments, each segment extending axially of the arbor, means removably securing said arcuate cylinder segments on said arbor and enabling circumferential adjustment of the segments relative to the arbor, said means securing said arcuate cylinder segments to said arbors with said axially extending gaps between segments on the arbors and said segments thus being relatively adjustable circumferentially on the arbors, each respective segment having a thin die plate thereon with said cutting lands formed on said die plate, said cutting lands extending circumferentially and axially of said segments, means for securing each die plate to its respective segment, said cutting lands on one arbor being offset from the cooperating cutting lands on the other arbor at the nip and being radially spaced from the cooperating lands on the other arbor at the nip and operable to rupture cut material moving through the nip, and wherein said cutting unit cuts said material into an article and broke and further includes means for effecting removal of said broke from said nip in a path different from the path of movement of the articles, said one arbor having a first gear mounted coaxially thereof and fixed thereto and said other arbor having a second gear mounted coaxially thereof and fixed thereto, means for adjusting said one arbor toward and away from said other arbor, gearing interposed between said first and second gears to transmit drive therebetween, means supporting said gearing to compensate for movement of said first gear with said one arbor without destroying the drive between said first and second gears so that said one arbor may be moved relative to the other arbor during drive of said arbors, said gearing comprising third and fourth gears, said third gear meshing with said first and fourth gears and said second gear meshing with said fourth gear, and said means supporting said gears comprising a linkage supporting said third gear for pivotal movement about the axis of said fourth gear toward and away from said first gear, means supporting said linkage and said fourth gear for pivotal movement about the axis of said second gear, and a spring biasing said third gear toward said first gear about the axis of said fourth gear.

* * * * *